United States Patent [19]

Leach et al.

[11] 4,357,588

[45] Nov. 2, 1982

[54] HIGH VOLTAGE FUSE FOR INTERRUPTING A WIDE RANGE OF CURRENTS AND ESPECIALLY SUITED FOR LOW CURRENT INTERRUPTION

[75] Inventors: John G. Leach, Hickory, N.C.; James J. Carroll, Clifton Park, N.Y.

[73] Assignee: General Electric Company, Philadelphia, Pa.

[21] Appl. No.: 270,032

[22] Filed: Jun. 3, 1981

[51] Int. Cl.[3] ..... H01H 85/04

[52] U.S. Cl. ..... 337/160; 337/162; 337/296

[58] Field of Search ..... 337/160, 161, 162, 163, 337/295, 296, 159

[56] References Cited

U.S. PATENT DOCUMENTS

| | | | |
|---|---|---|---|
| 2,866,037 | 12/1958 | Stewart | 337/161 |
| 3,294,936 | 12/1966 | Mikulecky | 337/160 |
| 3,835,431 | 9/1974 | Rosen et al. | 337/161 |
| 4,198,615 | 4/1980 | Mahieu | 337/162 |

*Primary Examiner*—Harold Broome

*Attorney, Agent, or Firm*—William Freedman; John P. McMahon

[57] ABSTRACT

A high voltage fuse for interrupting a wide range of currents and especially suited for low current interruption is disclosed. The fuse is comprised of a fuse element having a first and a second plurality of portions of reduced cross-sections. The second plurality of portions further comprise two or more parallel conducting paths some of which carry a portion of material which has a lower melting temperature than the melting temperature of the material of the fuse element. The parameters of the first and second plurality of reduced cross-section portions, the lower melting point material, and the fuse element itself are selected to adapt the fuse to provide proper protection for the various current conditions to which a high voltage transformer is subjected. The fuse element provides fast rupturing under short-circuit current conditions while also providing the characteristic of withstanding relatively high inrush current conditions. The fuse element further provides improved low current clearing ability for the fuse, and a fuse which responds quickly to through fault (secondary fault) conditions in a transformer.

10 Claims, 9 Drawing Figures

HIGH VOLTAGE FUSE FOR INTERRUPTING A WIDE RANGE OF CURRENTS AND ESPECIALLY SUITED FOR LOW CURRENT INTERRUPTION

BACKGROUND OF THE INVENTION

This invention relates to electrical fuses, and more particularly, to high voltage current limiting fuses that provide protection for an electrical transformer subjected to short-circuit, low overload and high overload current conditions.

It is desirable that high voltage current limiting fuses used to protect electrical devices, such as transformers, be adapted to the current flowing within the environment of the transformer. High voltage current limiting fuses for electrical transformers may typically be subjected to and expected not to melt or rupture during the occurrence of a surge or inrush current corresponding to 25 times the transformer rating for a relatively short time duration of 0.01 seconds. Similarly, the current limiting fuse may be expected not to melt or rupture during the occurrence of an inrush current corresponding to 12 times the transformer rating for a relatively long time duration of (0.1) seconds. However, under short-circuit conditions the high voltage fuse is desired to rupture so as to prevent damage to the electrical transformer. Furthermore, it is desirable that under short-circuit conditions the current limiting fuses rupture quickly so as to reduce or limit the amount of energy "let-through" the fuse that may damage the transformer.

Still further, it is desired that a fuse be capable of clearing all fault currents from a maximum interrupting rating down to those which cause fuse melting in one hour or more. A further requirement of fuses designed to protect transformers is the ability to melt relatively quickly when subject to a fault current corresponding to a short-circuit on the output of the transformer. Since this current may correspond to only 8 times rated current and require clearing in less than 2 seconds, it can be seen that many of these requirements impose conflicting demands on the fuse designer.

High voltage current limiting fuses are well known. One such high voltage current limiting fuse is described in U.S. Pat. No. 4,198,615 issued to W. R. Mahieu on Apr. 15, 1980. The fuse of the Mahieu patent has a plurality of current limiting elements and a plurality of arc gap establishing means both electrically coupled in parallel. Upon the occurrence of low current fault conditions the current limiting fuses sequentially distribute the fault current to the parallel arranged fuse elements one at a time to cause relatively fast melting of each of the fuse elements so as to enhance the clearance of low fault current conditions. It is considered desirable to accomplish the function of proper current limiting by the use of fuse elements alone and to reduce the number of required fuse elements.

A high voltage fuse comprising a plurality of similar fuse elements connected in parallel is described in U.S. Pat. No. 3,835,431 entitled "Electrical Fuse", and issued to Philip Rosen et al, Sept. 10, 1974. The Rosen et al electrical fuse provides protection for short-circuit, low overload and prolonged low overload current conditions.

A still further current limiting fuse is described in U.S. Pat. No. 2,866,037 entitled "ELECTRIC CURRENT LIMITING FUSE", issued to V. N. Stewart, Dec. 23, 1958. The Stewart current limiting fuse has constricted portions of reduced cross-sectional area for reducing arc energy and also an alloy-forming material for improving the response of the fuse to the occurrence of low, protracted overload current conditions. Neither Rosen et al or Stewart is adapted to discriminate between fault and transient or surge conditions. It is considered desirable to provide a fuse which is adapted to discriminate between a fault and a surge or transient and abnormal rush of current conditions into an electrical device. Under fault condition the fuse ruptures whereas under surge conditions the fuse withstands the surge and does not rupture.

Accordingly, it is an object of the present invention to provide a high voltage current limiting fuse that provides proper protection of an electrical device such as a transformer during short-circuit current conditions and high or low overload current conditions.

It is another object of this invention that the fuse withstand a wide range of current surges without rupturing.

It is a further object of this invention that the fuse elements within the fuse rupture quickly under short-circuit conditions so as to reduce the amount of energy "let-through" by the fuse.

These and other objects of this invention will become apparent to those skilled in the art upon consideration of the following description of the invention.

SUMMARY OF THE INVENTION

In accordance with one embodiment of the present invention a high voltage current limiting fuse is provided having fuse elements which quickly rupture under short-circuit current conditions, withstand relatively high inrush current conditions occurring for short durations, and clear relatively low current conditions such as lead to fuse element melting in one hour or more. The high voltage fuse interrupts a wide range of currents and is especially suited for low current interruption. The high voltage fuse has a tubular insulating casing and an inert granular material of high dielectric strength within the casing. The fuse further comprises one or more ribbon-type fuse elements. The elements are electrically connected in parallel when more than one is present. The one or more fuse elements each comprise at spaced locations along the length of an element a first and a second plurality of portions of first and second predetermined reduced transverse cross-sections, respectively, of the fuse element available for the conduction of current. The second plurality of reduced cross-section portions have two or more parallel conductive segments. The first predetermined reduced cross-section portions has a fusible time-current characteristic so as to initiate melting before the second predetermined reduced cross-section portion under first abnormal current conditions in which the current applied to the fuse element exceeds a first predetermined current value for a first predetermined time duration. The second predetermined reduced cross-section portions has a fusible time-current characteristic so as to initiate melting before the first predetermined reduced cross-section portions under second abnormal current condition in which the current applied to the fusible element is less than the first predetermined current value and has a time duration exceeding a second value which is greater than the first predetermined time duration. The second plurality of reduced transverse cross-section portions each have two or more conductive segments.

The two or more conductive segments having fusible materials one of which has a higher melting temperature than the material of said remaining segment or segments so that the one conductive segment melts after the other segment or segments under the second abnormal current conditions. The one segment of each of the second plurality of reduced cross-section portions has a sufficiently long melting time under the second abnormal current conditions to force all of the remaining segments of substantially all of the second plurality of reduced cross-section portions to melt before melting of the one segment.

The features of the invention believed to be novel are set forth with particularlity in the appended claims. The invention, itself, however, both as to its organization and method of operation, together with further objects and advantages thereof, may be best understood by reference to the following description taken in conjunction with the accompanying drawings.

DETAILED DESCRIPTION OF THE PREFERRED EMBODIMENT

Figures 1, 2, 3:
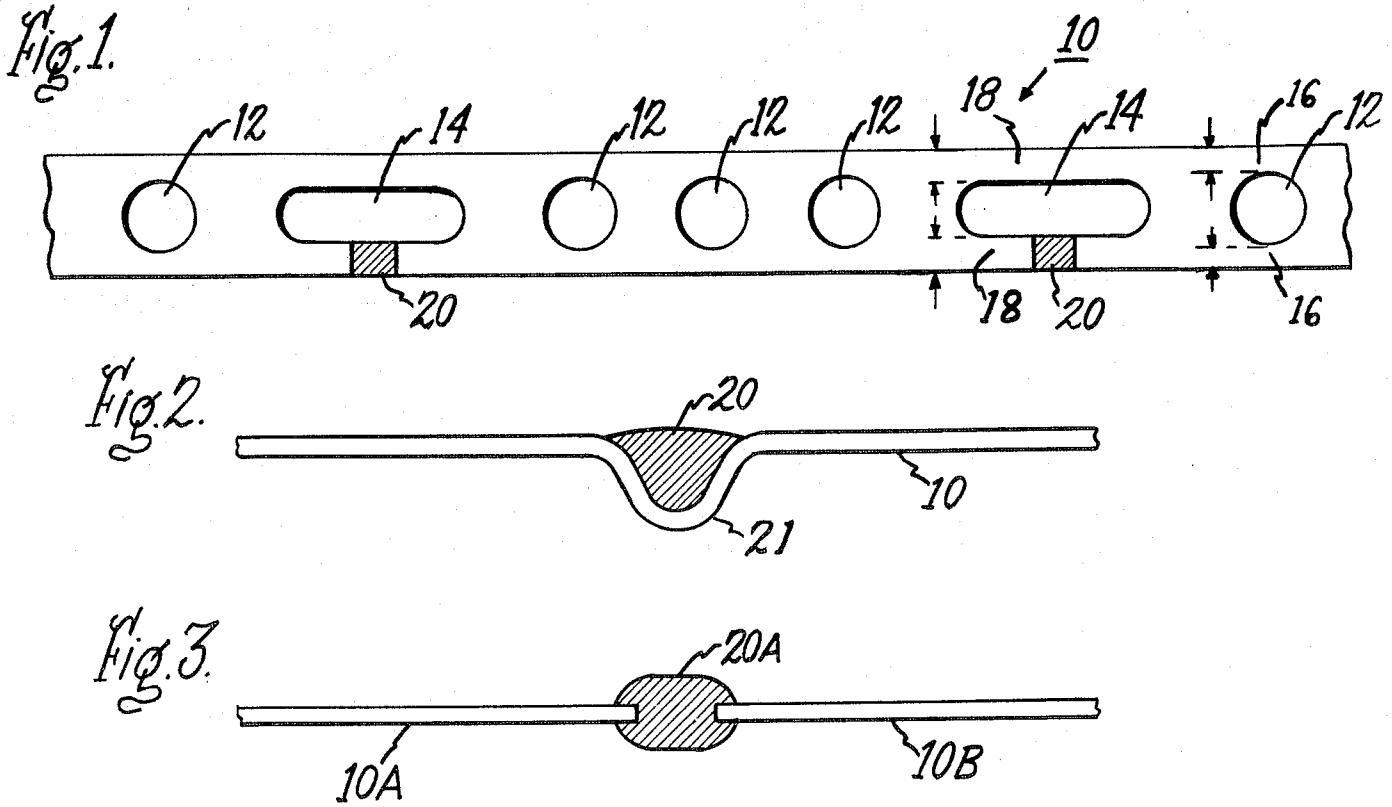
FIG. 1 shows a portion of a fuse element in accordance with one embodiment of the present invention.
FIGS. 2 and 3 show embodiments of attaching a lower melting point material to the fuse element.

FIG. 1 shows a portion of one fuse element 10 of the present invention. While we have shown a single fuse element 10 in FIG. 1, it is to be understood that the invention comprehends a fuse 40 (not shown) construction in which a plurality of fuse elements 10 are electrically connected in parallel. The fuse elements 10 of fuse 40 may be located wrapped about a supporting core which is within a tubular insulating housing having electrical terminals at its opposite ends and the fuse elements 10 provide an electric circuit between these terminals. Also, fuse 40 may be of the type not having a supporting core. For such a type, fuse elements 10 are connected between the electrical terminals located at the opposite ends of fuse 40. The insulating housing, the supporting core, and terminals are not shown in FIG. 1, but reference may be had to the U.S. Pat. No. 3,294,936 issued on Dec. 27, 1966 to H. W. Mikulecky, for such a showing. This latter patent is incorporated by reference in the present application.

Each fuse element 10 has a ribbon-type shape and is comprised of an electrically conductive fusible material such as silver. The dimensions of each fuse element 10 are dependent upon the current carrying capabilities of the device for which it is desired that the fuse 40 protect. For example, if an electrical transformer has a rating of 1000 KVA and 13.2 KV the fuse 40 may have five parallel arranged elements 10 within it each with a typical length of 1000 mm, a width of 5 mm and a thickness of 0.05 mm. Each of the five elements 10 may have a current carrying capability of 13 amperes of continuous current.

The fuse element 10 comprises a first plurality of cutouts or perforations 12 and a second plurality of cutouts or slots 14. The slots 14 are separated from each other by a group formed by perforations 12 which are spaced from each other. The perforations 12 and slots 14 provide, at spaced locations along the length of the fuse element 10, a first and a second plurality, respectively, of portions of fuse element 10 of reduced transverse cross-section available for the conduction of current. One of the neck portions at each side of slot 14 has a portion 20, shown in FIG. 1, to which is attached a fusible material, such as solder having a lower melting temperature substantially less than that of the fusible material of the element 10. FIGS. 2 and 3 show various embodiments of attaching the portion 20 to the desired neck portions of fuse element 10.

The fuse element 10 is shown in FIG. 2 as depressed or deformed at the desired neck portion so as to form a channel or trough 21. The lower melting temperature substance, such as solder, is melted within channel 20A to give intimate contact with the fuse element 10.

FIG. 3 shows a portion 20A as interconnecting two separated segments 10A and 10B of the fuse element 10. The portion 20A is mechanically attached to each segment 10A and 10B, by suitable means, and provides the electrical interconnecting path between the segments 10A and 10B located at the desired elongated slots 14 of the fuse element 10.

FIG. 1 shows one embodiment of the perforations 12 of the fuse element 10 as formed by cutouts in the central region of fuse element 10. The separation between the perforations 12 and their related outer necks of fuse element 10 form parallel restriction regions 16 as shown in FIG. 1. Perforations 12 are shown in FIG. 1 as having a circular shape, however other shapes may be used to enclose definable restrictive regions 16. The perforations 12 and parallel restriction regions 16, for a current carrying rating of 13 amperes, may have a typical diameter of 3 mm and a typical width of 0.7 mm respectively.

FIG. 1 further shows one embodiment of slots 14 formed by cutouts in the central region of fuse element 10. The separation between the slots and their related outer necks of fuse element 10 form parallel restricted regions 18 as shown in FIG. 1. Slots 14 are shown as having an elongated shape, however other shapes may be used to enclose definable restrictive regions 18. The slots 14 and parallel restricted regions 18, for previously mentioned current rating of 13 amperes, may have a typical length of 18 mm and a typical width of 1.2 mm respectively.

As discussed in the "Background" section it is desirable that a fuse having fuse elements, such as fuse elements 10, be adapted to withstand relatively high inrush currents that occur for various time durations and are applied to an electrical device such as a high voltage transformer. It is also desirable that under short circuit conditions that the fuse element 10 rupture very quickly so as to reduce or substantially limit the amount of energy that is "let-through" the fuse 40 under these short circuit current conditions.

As it is known, the time duration and the current density applied to a fusible material, along with the various cross sections of the fuse element material available to conduct the applied current, are factors which determine the fusible time-current characteristic for the melting or rupturing of the fuse element 10. The cross-sectional portions of fuse 10 determine the volume that the heat, caused by the applied current, may be dissipated into while its surface area also affects heat loss from the element 10. Furthermore, the selection of the melting temperature for the portions of fuse element 10 also determines the rupturing of fuse element 10. The geometry (including length, width and thickness) of the restrictive regions 16 and 18 and the addition of a lower melting point material to portion 20 are selected to provide a fuse element 10 that is adapted to the current flowing within environment of the high voltage transformer.

The cross-section and geometry of restrictive regions 16 are selected so as to rupture when the current applied to the fuse element 10 exceeds a first current level value and has a first time duration which exceeds a first predetermined value. Similarly, the cross-section and geometry of restrictive regions 18 are selected so as to rupture when the current applied to the fuse element 10 is less than the first predetermined value, and has a second time duration which exceeds the first predetermined value. In a fuse 40 with five fuse elements 10 having the dimensions previously given for regions 16 and 18, the application of a current greater than 1500 amperes for a time duration of approximately 0.01 seconds causes regions 16 to melt and rupture and the application of a current greater than 620 amperes for a time duration of approximately 0.10 seconds causes region 18 to melt and rupture. A current of 520 amperes is representative of a typical inrush current having a value of 12 times the current rating of the electrical transformer protected by fuse 40. Similarly, a current of 1100 amperes is representative of a typical inrush current having a value of 25 times the current rating of the electrical transformer protected by the fuse 40. When the fuse 40 is subjected to a short-circuit current, the $I^2t$ or the energy "let through" the fuse 40 before it begins to arc can be calculated. With the number and dimensions of fuse element 10, previously given, and a high short-circuit current (for example, 50,000 amperes), the $I^2t$ required to melt restricted region 18 would be approximately 30,000 $amp^2$ seconds, while that required to melt region 16 would be only approximately 10,000 $amp^2$ seconds. Region 18 thus determines the limitation for 0.1 second inruch currents, while region 16 limits the $I^2t$ required to melt the fuse on short-circuit. Although region 16 would give a good 0.1 second surge withstand, it would not give good protection to the transformer for moderate overloads, such as occur when a fault exists on the secondary of the transformer. Using the example of fuse 40 and transformer previously given, if a through-fault of approximately eight times the transformer rating, 345 amperes, were applied to the fuse 40, region 18 would cause the melting of fuse elements 10 in approximately two seconds, while region 16 would require approximately 10 seconds to melt. In addition, region 16 would be incapable of providing low overcurrent operation, such as occurs with current causing the melting of fuse elements 10 in one hour or more.

As will be explained hereinafter with regard to the operation of fuse 40 in response to low overload current conditions, in particular the fuse element 10, the response of fuse element 10 to the low overcurrent conditions is primarily controlled by the portion 20 of low melting material located on the neck portion of the parallel arranged restrictive regions 18. The portions 20 provide a well known "M" effect such that the portions 20 having a lower melting temperature than the remainder of the fuse element 10 are the first or initial portions of fuse element 10 to melt under low overcurrent conditions. When portions 20 cause one half of the parallel restrictive regions 18 to open, the current flow is preferentially distributed to the intact parallel restriction 18 to enhance rupturing of the fuse element 10 under the low overcurrent conditions. The operation of fuse 40 in response to surge conditions will first be discussed.

Fuse 40 Operation in Response to Surge Conditions

Figure 4:
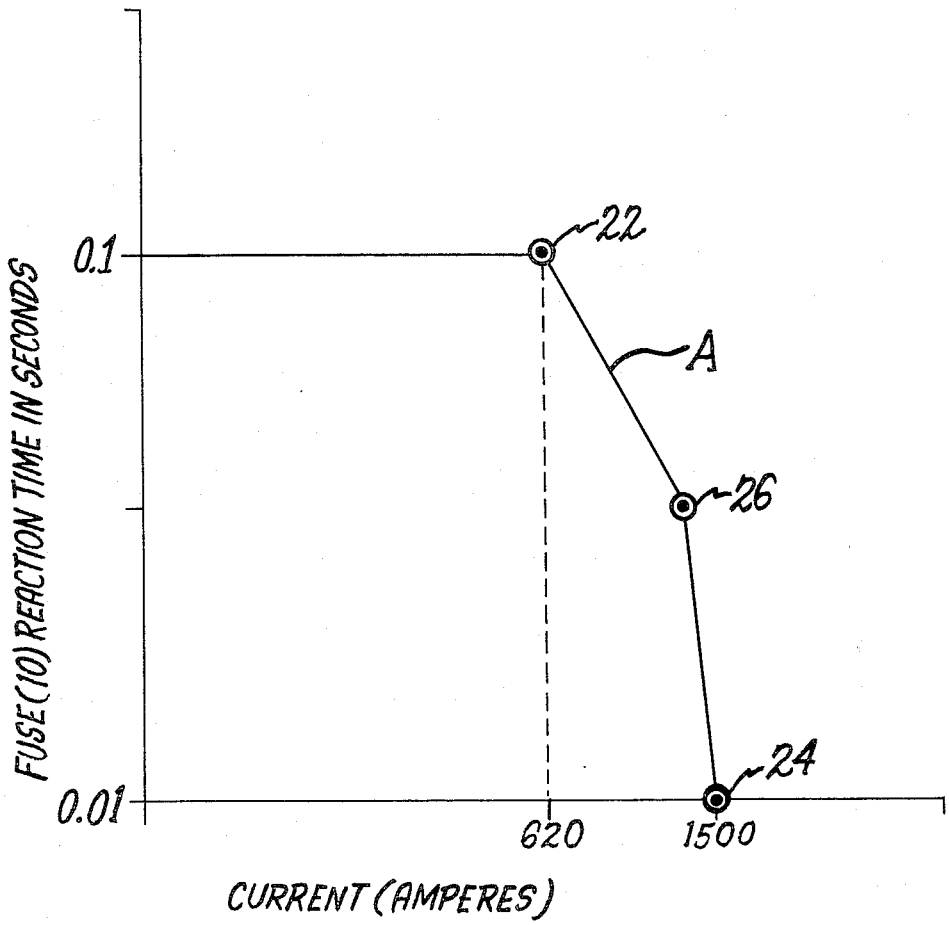
FIG. 4 shows, in part, the characteristics of the fuse element shown in FIG. 1.

The response characteristic of fuse 40 having five fuse elements 10 to the aforementioned inrush currents each having typical time durations of 0.01 and 0.1 seconds is shown in FIG. 4 as a plot A. The X coordinate of FIG. 4 is a plot of the current in amperes applied to fuse 40 whereas the Y coordinate of FIG. 4 is a plot of the duration of the applied current.

From FIG. 4 it should be noted that a circular notation 22 is used to represent the response of fuse 40, plot A, to an applied or inrush current having a value of approximately 620 amperes, and having a time duration of 0.1 seconds. The circular notation 22 is indicative of the melting or rupturing of regions 18 of the fuse elements 10. FIG 4 uses a circular notation 24 to represent the response of fuse 40 to an inrush current having a value of 1500 amperes, and having a time duration of 0.01 seconds. The circular notation 24 is indicative of the melting or rupturing of regions 16 of the fuse elements 10.

The mid-portion or transitional response of plot A is indicated by a circular notation 26. For applied currents having values greater than indicated by notation 26, the rupturing of fuse elements 10 is primarily controlled by regions 16 and, conversely, for currents less than indicated by notation 26 the rupturing of fuse elements 10 is primarily controlled by regions 18. The response of fuse element 10 to a short circuit current (one greater than that corresponding to response 24) is not shown in FIG. 4, nor is the response to a low overcurrent (one less than that corresponding to response 22). The response of fuse 40 to a short-circuit current and to a low overcurrent condition may be best understood by the following descriptions of the operations of fuse 40.

Fuse 40 Operation in Response to Short Circuit Conditions

The response of fuse 40, having multiple fuse elements 10, to a short circuit current condition is primarily controlled by restricted portions 16 of each fuse element 10, whereas, the response of the fuse 40 to low-overcurrent conditions is primarily controlled by an interaction between the restrictions portions 18 and portions 20 of the individual fuse elements 10 so that multiple arcing of the fuse elements 10 may be realized.

The multiple fuse elements 10 of fuse 40 each responds to a short-circuit current condition by quickly melting restricted portions 16. The melting of the restricted portions 16 of each fuse element 10 provides an open circuit to the applied short-circuit current.

Fuse 40 Operation in Response to Low-Overcurrent Conditions

The overall operation of fuse 40 having multiple fuse elements 10 to low-overcurrent conditions may best be understood by first describing the individual operation of the fuse element 10 to this condition. When an individual fuse element 10 is subjected to a low-overcurrent, portions 20, having the lowest melting temperature, melt first and open one-half of the parallel restrictions 18. The overcurrent then flows in the intact parallel segment of restrictions 18, and, in effect, increases the current density of the overcurrent by a factor approximately equal to the ratio of the combined widths of restrictions 18 to the width of the intact segment of the restrictions 18. The increase in current density decreases the time required to melt the intact segment of restrictions 18. However, this time value should be sufficiently long so as to force all series portions 20 along each fuse element 10 to open before the first intact segment 18 of fuse element 10 opens. The restriction of this melting time to its desired value requires further discussion of the fuse element. To assure this melting time for the intact portion is sufficiently long the interactions between the multiple fuse element 10 requires discussion.

When the first intact segment does open in one element of a multi-element fuse 40, the current normally flowing in this segment is now shared by the remaining segments, in particular, the restrictions 18 of all of the remaining fuse elements 10. This further increases the current density in the intact segments of restrictions 18 of the remaining fuse elements 10. The number of fuse elements 10, one or more, are so chosen in conjunction with the dimensions of restrictions 18, and the desired minimum interrupting current of the fuse, such that when the overcurrent flows in only one fuse element 10, all series intact restrictions 18 of that elements 10 melt and arc. Series arcing is difficult to achieve unless the current density in series restrictions are above a value, characteristic of the restriction geometry. For example, a restriction 18, as previously described, may require a current density above 1500 amps per square millimeter if successful series multiple arcing is to be achieved. The use of portions 20 on part of each restricted portion 18 reduces the number of parallel elements needed to achieve successful multiple arcing and thus overcurrent clearing for a given surge withstand requirement. Further, the dimensioning of restricted regions 16 and 18 allow for an optimum operating time-current characteristic in the general region of 0.1 to 10 seconds, combined with the optimum characteristic around 0.01 seconds and a minimum energy let-through with high fault current, giving operation in under 0.01 seconds.

It should now be appreciated that fuse 40, in particular, fuse element 10, is adapted to the current environment of an electrical device such as a high voltage transformer. The fuse element 10 discriminates against inrush current conditions by not rupturing, whereas, under short circuit conditions the fuse element 10 quickly ruptures to limit or reduce the amount of "let-through" energy. Use of fuse element(s) 10 further gives fuse operation in the 2–10 second region with a relatively low current and a fuse capable of clearing very low overcurrents.

It should be further appreciated that the dimensions of perforations 12, slots 14, and restrictive regions 16 and 18 of fuse elements 10 may be selected to adapt the fuse elements 10 to various current environments in which various electrical devices may be subjected. Further embodiments of fuse element 10 are shown in FIGS. 5–9.

Figure 5:
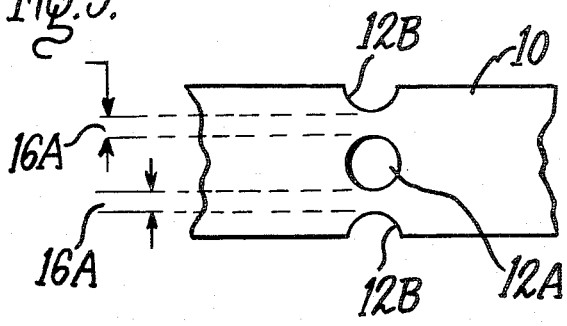
FIGS. 5–9 show various embodiments of the fuse element of the present invention.

FIG. 5 shows an embodiment of establishing alternate restrictive regions 16A. The restrictive regions 16A are formed by the placements of perforations 12A, similar to the previously described perforations 12, in the central region of fuse element 10 and also the placement of two additional perforations 12B, approximately one-half of perforation 12, at each neck of fuse element 10.

Figure 6:
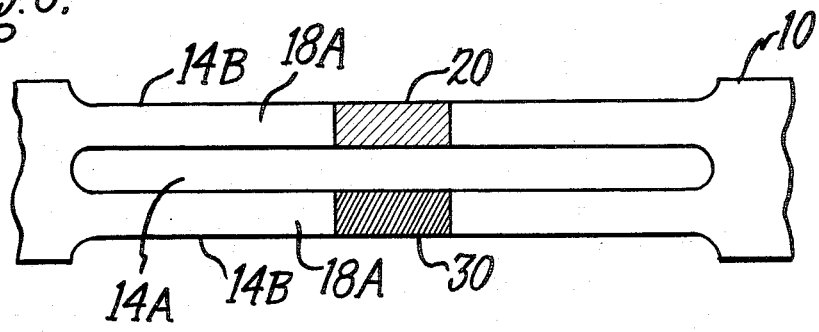

FIG. 6 shows an embodiment of establishing alternate restrictive regions 18A. The restrictive regions 18A are formed by the placements of a slot 14A, similar to the previously described slot 14, in the central region of fuse element 10 and also the placement of two additional slots 14B, approximately one-half of slot 14, at each edge of the fuse element 10. FIG. 6 further shows two portions, (1) the portion 20 shown in a cross-hatched representation and having the "M" effect material as previously described, and (2) a portion 30 also shown in a cross-hatched representation, formed of a material having a higher melting point than the "M" effect material of portion 20. The portion 20 being of a lower melting temperature than portion 30 assures portion 20 melts first, relative to portion 30, so as to provide a predetermined preferential-sequential distribution of current flow between the restrictive regions 18A. Still further, restrictive regions 18A may be selected to have different widths so that one region 18A having a greater width and volume may be the first to rupture so as to assure the preferential distribution of current between the regions 18A.

Figure 7:
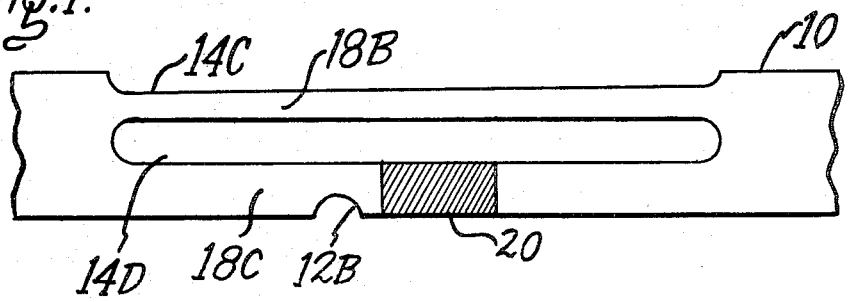

FIG. 7 shows a further embodiment of establishing alternate restrictive regions 18B and 18C. Restrictive region 18B is formed by the placement of a slot 14D, similar to the previously described slot 14, in the middle region of fuse element 10, and a slot 14C, approximately one-half of slot 14, at one edge of the fuse element 10. Restrictive region 18C is also formed by the placement of slot 14, however, the previously described perforation 12B also forms restrictive region 18C. Perforation 12B may be located near a portion 20 so that upon the melting of the portion 20 the segment of the reduced cross-section region 18C, defined by perforation 12B may be the first to rupture. Similar usage of a perforation 12B is applicable to any or all of the embodiments of fuse element 10 of the present invention.

Figure 8:
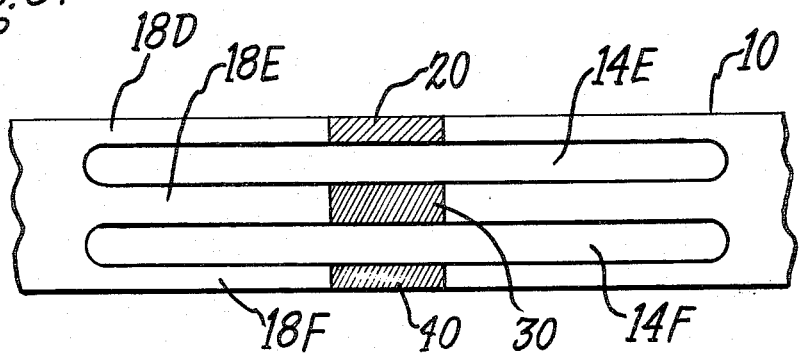

FIG. 8 shows a still further embodiment of establishing alternate restrictive regions 18D, 18E, and 18F having portions 20, 30 and 40 respectively. Portion 40 is formed of a material having a higher melting temperature than the material of portion 20 or portion 30. The restrictive regions 18D, 18E and 18F are formed by the placement of slots 14E and 14F, each similar to slot 14, into selected regions of fuse element 10. From FIG. 8 it may be seen that the selected regions may be chosen so as to establish restrictive regions 18D, 18E and 18F as having similar or different desired dimensions. The desired dimensions of restrictive regions 18D, 18E and 18F may in turn be selected to attain preferential distribution of current flow amongst the regions 18D, 18E and 18F.

Figure 9:
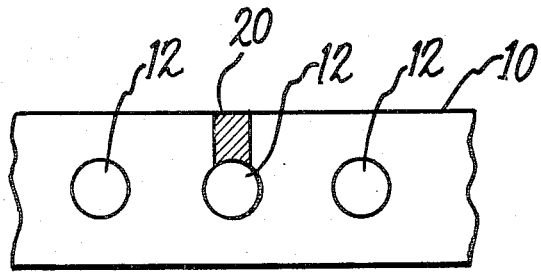

FIG. 9 shows a further embodiment of fuse element 10 having a portion 20 positioned at one edge of fuse element 10 and abutting a perforation 12. The portion 20 provides the "M" effect to assist in the rupturing of the cross-section of fuse element 10 at which the perforation 12 having portion 20 is positioned.

It should now be appreciated that the selection of the dimensions of fuse element 10 in accordance with the various embodiments of the present invention provides a fusible device adaptable to a wide variety of current environments to assure proper protection of a wide variety of electrical devices.

While we have shown and described particular embodiments of our invention, it will be obvious to those skilled in the art that various changes and modifications may be made without departing from our invention in its broader aspects; and we, therefore, intend herein to cover all such changes and modifications as fall within the true spirit and scope of our invention.

What we claim is:

1. A high voltage fuse for interrupting a wide range of currents and especially suited for low current interruption having a tubular insulating casing, and an inert granular material of high dielectric strength within said casing, said fuse further comprising:

one or more ribbon-type fuse elements, the elements being electrically connected in parallel when more than one is present;

said one or more fuse elements comprising at spaced locations along the length of an element a first and a second plurality of portions of first and second predetermined reduced transverse cross-sections, respectively, of the fuse element available for the conduction of current, said second plurality of reduced cross-section portions having two or more parallel conductive segments;

said first predetermined reduced cross-section portions having a fusible time-current characteristic so as to initiate melting before the second predetermined reduced cross-section portion under first abnormal current conditions in which the current applied to the fuse element exceeds a first predetermined current value for a first predetermined time duration;

said second predetermined reduced cross-section portions having a fusible time-current characteristic so as to initiate melting before the first predetermined reduced cross-section portions under second abnormal current conditions in which the current applied to the fusible element is less than the first predetermined current and has a time duration exceeding a second value which is greater than the first predetermined time duration;

said two or more conductive segments having fusible materials one of which has a higher melting temperature than the material of said remaining segment or segments so that said one conductive segment melts after the other segment or segments under said second abnormal current conditions;

said one segment of each of said second plurality of reduced cross-section portions having a sufficiently long melting time under said second abnormal current conditions to force all of said remaining segments of substantially all of the second plurality of reduced cross-section portions to melt before melting of said one segments.

2. A high voltage fuse according to claim 1 wherein said first plurality of portions of a first predetermined reduced transverse cross-sections comprises;

two neck portions of said fuse element formed by a cutout having a circular shape in the central region of the fuse element.

3. A high voltage fuse according to claim 1 wherein said second plurality of portions of a second predetermined reduced transverse cross-sections comprises;

two neck portions extending along said fuse element and formed by a slot-shaped cutout elongated along the length of the fuse element and located in the central region of the fuse element, said two extending neck portions, in turn, forming two parallel conduction segments one of which has a fusible material having a higher melting temperature than the material of the other segments or segments.

4. A high voltage fuse according to claim 1 wherein a fusible material having a lower melting temperature than the material of the other segment or segments is attached to one of the parallel conducting segment in a channel located in the central region of said one parallel conducting segment.

5. A high voltage fuse according to claim 1 wherein a fusible material having a lower melting temperature than the material of the other segment or segments is mechanically attached to two separated segments of one of the conducting segment and provides the electrical interconnecting path to the separated segments.

6. A general purpose high voltage fuse according to claim 1 wherein said first plurality of portions of first predetermined reduced transverse cross-sections comprises;

two portions of said fuse element separated by a cutout having a circular shape in the central region of said fuse element, each of said two separated portions having a semicircular cutout formed at its outer necks.

7. A general purpose high voltage fuse according to claim 1 wherein said second plurality of portions of a second predetermined reduced transverse cross-sections comprises;

two portions of said fuse element separated by a cutout having an elongated shape in the central region of said fuse element, said two separated portions having outer necks with a further cutout having an elongated shape further having dimensions of about half of said central elongated shaped cutout, each of said two separated portions of said second plurality having a portion of fusible material located in their central region having a lower melting temperature than that of said fuse element, said two portions of lower melting temperature material being such as to have melting temperatures in which one portion has a higher melting temperature material than the other portion.

8. A general purpose high voltage fuse according to claim 1 wherein said second plurality of portions of a second predetermined reduced transverse cross-sections comprises;

two portions of said fuse element separated by a cutout having an elongated shape which is offset from the central region of said fuse element, one of said two separated portions having an outer neck with a further cutout having an elongated shape having dimensions of about one-half of said elongated cutout offset from said central region, the other separated portion having a portion of fusible material located in its central region having a melting temperature which is lower than that of said fuse element, said other separated portion further having a semi-circular cutout placed in its outer neck and located near the lower fusible material located at the central region.

9. A general purpose high voltage fuse according to claim 1 wherein said second plurality of portions of a second predetermined reduced transverse cross-sections comprises;

three portions of said fuse element comprising a first and a second portion located at opposite necks of said fuse elements and a third portion located in the central region of said fuse element, said first and third portions being separated by an elongated cutout offset from the central region of said fuse element, said second and third portions being separated by an elongated cutout also offset from the central region, said first portion having a portion of fusible material located in its central region having a lower melting temperature than the material of said fuse element, said second and third portions having portions of fusible material located in their central region having a melting temperature which are lower than the material of the fuse element but greater than that of the fusible material located at said central region of said first portion.

10. A general purpose high voltage fuse according to claim 2 in which one of said two neck portions has a portion of fusible material having a lower melting temperature than the material of said fuse element.

* * * * *